US011639285B2

(12) United States Patent
Siironen et al.

(10) Patent No.: US 11,639,285 B2
(45) Date of Patent: May 2, 2023

(54) ELEVATOR CAR

(71) Applicant: KONE Corporation, Helsinki (FI)

(72) Inventors: Tapio Siironen, Helsinki (FI); Aleksi Immonen, Helsinki (FI); Pekka Halonen, Helsinki (FI); Ari Pitkänen, Helsinki (FI); Tapani Talonen, Helsinki (FI); Ville Myyryläinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 17/159,839

(22) Filed: Jan. 27, 2021

(65) Prior Publication Data

US 2021/0269283 A1 Sep. 2, 2021

(30) Foreign Application Priority Data

Feb. 28, 2020 (EP) ..... 20159947

(51) Int. Cl.
*B66B 11/02* (2006.01)

(52) U.S. Cl.
CPC ..... *B66B 11/0246* (2013.01)

(58) Field of Classification Search
CPC ..... B66B 11/0246; B66B 5/0087
See application file for complete search history.

(56) References Cited

U.S. PATENT DOCUMENTS 6,880,678 B1 * 4/2005 Schneider ..... B66B 11/0246 187/314
9,546,078 B2 * 1/2017 Paasisalo ..... B66B 11/0226
11,104,550 B2 * 8/2021 Fernandez ..... B66B 11/0246
2006/0289244 A1 * 12/2006 Sittler ..... B66B 11/0246 187/401
2007/0056810 A1 * 3/2007 Fernandes ..... B66B 11/0246 187/401
2019/0135586 A1 * 5/2019 Haapaniemi ..... B66B 1/3415
(Continued)

FOREIGN PATENT DOCUMENTS

FR 2 841 885 A1 1/2004
WO WO 2018/104578 A1 6/2018

OTHER PUBLICATIONS

European Search Report issued in EP 20159947.9, dated Sep. 14, 2020.

*Primary Examiner* — Michael A Riegelman
(74) *Attorney, Agent, or Firm* — Birch, Stewart, Kolasch & Birch, LLP

(57) ABSTRACT

An elevator car (100) defining an interior space (1) for accommodating passengers. The elevator car (100) comprises an openable roof (2), horizontal roof guide rails (13*a*, 13*b*) arranged on a top side of the elevator car (100), a support structure (4) pivotably mounted to the guide rails (13*a*, 13*b*) by a first joint (5*a*, 5*b*), and a working platform (6) pivotably and movably mounted to the support structure (4) by a second joint (7*a*, 7*b*) arranged at a distance from the first joint (5*a*, 5*b*). The working platform (6) is pivotable between a retracted position, in which said working platform is oriented close to the guide rails (13*a*, 13*b*) in the top side of the elevator car, and a deployed position, in which the working platform (6) is in the interior space (1), at a distance from the guide rails (13*a*, 13*b*). The first joint (5*a*, 5*b*) being arranged movable along the guide rails (13*a*, 13*b*).

22 Claims, 3 Drawing Sheets

(56) References Cited

U.S. PATENT DOCUMENTS

| | | | | |
|---|---|---|---|---|
| 2019/0263629 | A1* | 8/2019 | Fernandez | B66B 11/0246 |
| 2019/0330024 | A1* | 10/2019 | Durand | B66B 11/0226 |
| 2019/0389698 | A1* | 12/2019 | Jimenez-Gonzalez | B66B 11/0246 |
| 2021/0139284 | A1* | 5/2021 | Fever | B66B 11/0246 |
| 2021/0155458 | A1* | 5/2021 | Montigny | B66B 11/0246 |
| 2021/0269279 | A1* | 9/2021 | Talonen | B66B 11/0246 |
| 2021/0269283 | A1* | 9/2021 | Siironen | B66B 11/0246 |
| 2022/0024724 | A1* | 1/2022 | Fauconnet | B66B 11/0246 |

* cited by examiner

ELEVATOR CAR

BACKGROUND

The invention relates to an elevator car defining an interior space for accommodating passengers.

Elevators having a low headroom are more and more popular. The headroom in this context means the clearance between the roof of the elevator car and the ceiling of the elevator shaft in the situation when the elevator car is at its uppermost position.

Various tasks, such as inspections, adjustment works, maintenance or repairs, later referred in a shorter way only as "maintenance work", are often performed at the upper part of the elevator shaft. The elevator car may have an openable car roof, and the free safety space needed for safety of maintenance personnel is formed at least partly, sometimes completely, inside the elevator car when the elevator car is in its uppermost position. The elevator car may comprise a working platform that is used in maintenance work for allowing access of the maintenance personnel above the elevator car.

However, known working platforms are heavy and thus difficult and painstaking to use.

BRIEF DESCRIPTION

Viewed from a first aspect, there can be provided an elevator car defining an interior space for accommodating passengers, the elevator car comprising

- an openable roof,
- horizontal roof guide rails arranged on a top side of the elevator car,
- a support structure pivotably mounted to the guide rails by a first joint,
- a working platform pivotably and movably mounted to the support structure by a second joint arranged at a distance from the first joint,
- the working platform being pivotable between
  - a retracted position, in which said working platform is oriented close to the guide rails in the top side of the elevator car, and
  - a deployed position, in which the working platform is in the interior space, at a distance from the guide rails,
- the first joint being arranged movable along the guide rails in direction of the openable roof.

Thereby a light and easily handled structure that still provides access to all objects on or above the elevator car may be achieved. Furthermore, the very same structure is suitable for elevator cars varying in their dimensions.

The arrangement is characterised by what is stated in the independent claim. Some other embodiments are characterised by what is stated in the other claims. Inventive embodiments are also disclosed in the specification and drawings of this patent application. The inventive content of the patent application may also be defined in other ways than defined in the following claims. The inventive content may also be formed of several separate inventions, especially if the invention is examined in the light of expressed or implicit sub-tasks or in view of obtained benefits or benefit groups. Some of the definitions contained in the following claims may then be unnecessary in view of the separate inventive ideas. Features of the different embodiments of the invention may, within the scope of the basic inventive idea, be applied to other embodiments.

In one embodiment, the roof guide rails extend over the entire length of the openable roof. An advantage is that the position of the working platform may be changed and the compact size of the platform, as required by easy handling and minimal storage space, will not limit the reach of the service person to components outside the car and on shaft walls.

In one embodiment, the support structure comprises a framework that includes first suspension bars, each of the suspension bars arranged between one first joint and one third joint. An advantage is that a simple support for the working platform may be achieved.

In one embodiment, the first suspension bar has an invariable length. An advantage is that a simple and light structure may be achieved.

In one embodiment, the support structure comprises at least one transversally arranged element connected to the first suspension bars between the first joint and the third joint, creating a guard rail for the working platform in its deployed position. An advantage is that safety of use of the working platform may be improved.

In one embodiment, the framework comprises a first upper connecting element arranged between two first joints. An advantage is that it may protect the service person working from falling off the working platform, and that the first joints are moving with similar pace.

In one embodiment, the framework comprises a lower connecting element arranged between two third joints. An advantage is that support for one edge of the working platform may be provided.

In one embodiment, the support structure comprises a centre guide extending between the lower connecting element and the transversally arranged element. An advantage is that it may protect the service person working from falling off the working platform.

In one embodiment, the working platform is movably and pivotably connected to the centre guide by the second joint. An advantage is that the position of the working platform may be changed easily.

In one embodiment, the first joint is attached pivotably to a carriage that is movable along the guide rails. An advantage is that easy movements of the support structure and the working platform may be achieved. The roof guide rails extending over the entire length of the openable roof and the working platform movable on the guide rails will provide the service person a safe reach to components outside the car and on shaft walls despite the limited area of the working platform.

In one embodiment, the elevator car comprises a locking mechanism to prevent movement of the first joints along the horizontal roof guide rails when the suspension bars are in an upright position. An advantage is that safety of use of the working platform may be improved.

In one embodiment, the elevator car comprises a first diagonal support element arranged movably and pivotally to the guide rails, and pivotally to the support structure, the first diagonal support element connecting diagonally the support structure to the guide rails when the working platform is in the deployed position. An advantage is that sturdiness of the support structure may be improved and its movements between the retracted and the deployed position may be controlled.

In one embodiment, a second upper connecting element is arranged to connect two first diagonal support elements at the guide rails. An advantage is that it may protect the service person working from falling off the working platform.

In one embodiment, the elevator car comprises a second diagonal support element arranged movably and pivotally to the guide rails and pivotally to the support structure, the second diagonal support element connecting diagonally the support structure to the guide rails when the working platform is in the deployed position, the second diagonal support element actuating the locking mechanism to prevent movement of the first joints along the horizontal roof guide rails when the suspension bars are in an upright position. An advantage is that the locking mechanism is automatically on when the working platform is in the deployed position.

In one embodiment, the length of the working platform is not more than 50% of the length of the support structure. An advantage is that the weight of the working platform may be reduced.

In one embodiment, a ladder is arranged pivotably to the working platform, on opposite side thereof in relation to the support structure, the ladder extending from the working platform towards a floor of the elevator car when the working platform is in the deployed position. An advantage is that access to the working platform may be simplified.

In one embodiment, the ladder is arranged to extend against the floor and create a support for the working platform in the deployed position. An advantage is that sturdiness of the working platform may be improved in a simple way.

In one embodiment, a ladder diagonal support is arranged to control movement of the ladder during movement of the working platform between the retracted position and the deployed position. An advantage is that the movement of the ladder is always controlled and safe.

In one embodiment, the width of the ladder is essentially smaller than the width of the working platform, and the ladder is arranged asymmetrically in relation to the working platform. An advantage is that e.g. an equipment unit may be arranged next to the ladder.

In one embodiment, the elevator car comprises an equipment unit that is arranged to lie next to the ladder when the working platform is in the retracted position. An advantage is that a compact and thin structure of the roof of the elevator car may be provided, still providing protection for the equipment unit.

In one embodiment, the equipment unit is attached to the elevator car by a hinge system, and that the equipment unit is pivotally movable from next to the ladder to a position inside the interior space of the elevator car. An advantage is that the equipment unit is easy to use.

In one embodiment, the support structure and the working platform, when they are in the retracted position, are arranged to lie between the openable roof and a ceiling of the elevator car. An advantage is that the support structure and the working platform are out of sight and also protected against fouling.

BRIEF DESCRIPTION OF FIGURES

Some embodiments illustrating the present disclosure are described in more detail in the attached drawings, in which.

In the figures, some embodiments are shown simplified for the sake of clarity. Similar parts are marked with the same reference numbers in the figures.

DETAILED DESCRIPTION

Figure 1:
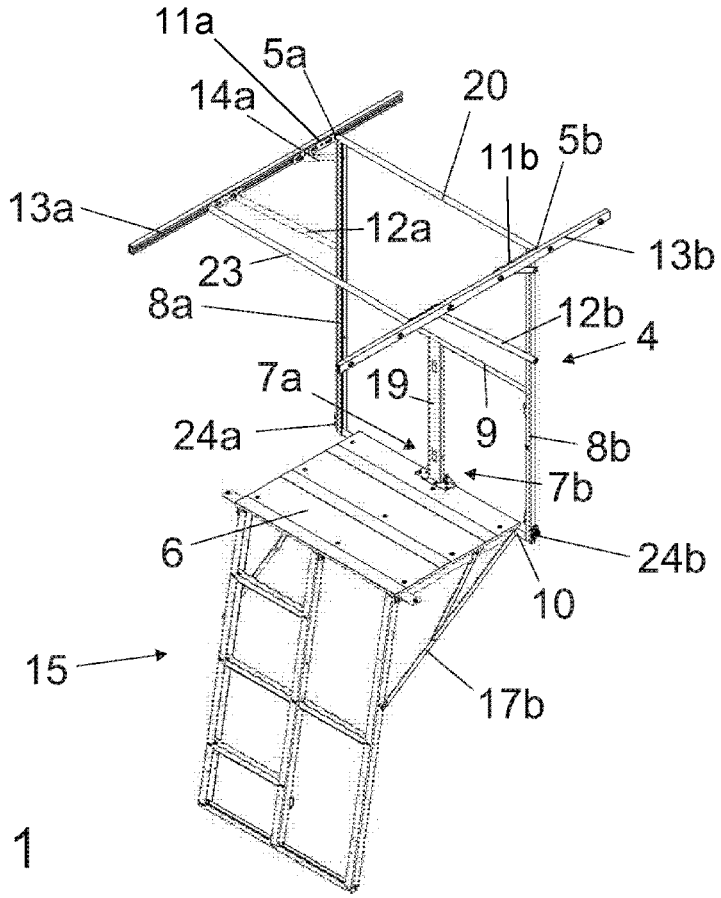
FIG. 1 is a schematic perspective top view of an arrangement shown above.
Figure 2:
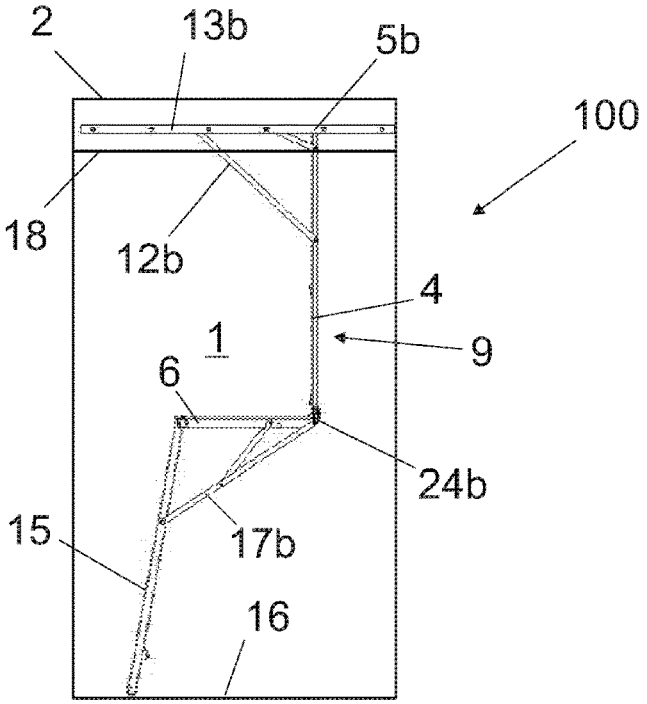
FIG. 2 is a schematic side view of an elevator car comprising the arrangement shown in FIG. 1 in partial cross-section.
Figure 3:
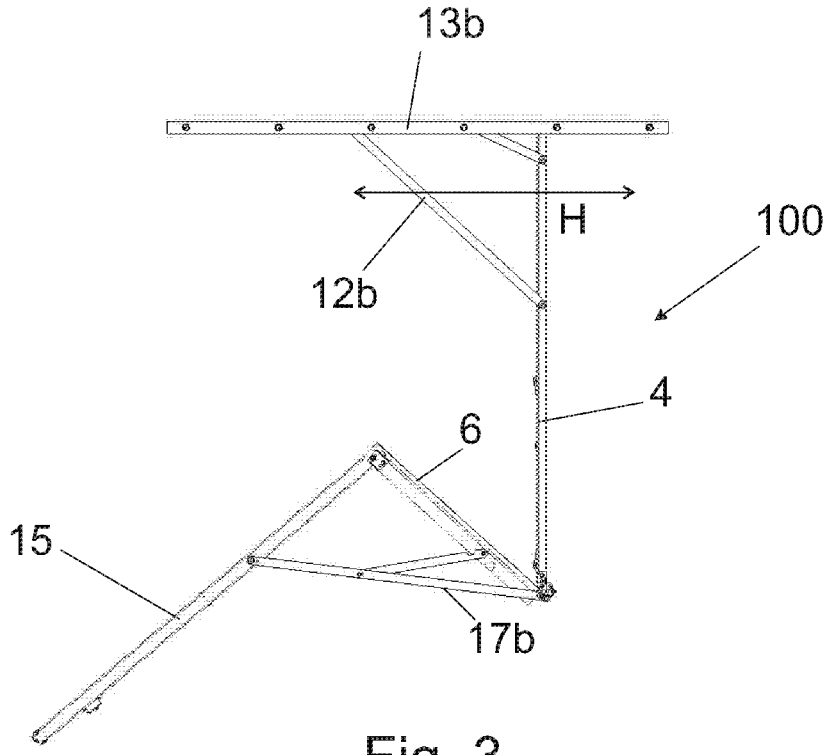
FIG. 3 is a schematic side view of the arrangement shown in FIG. 1.
Figure 4:
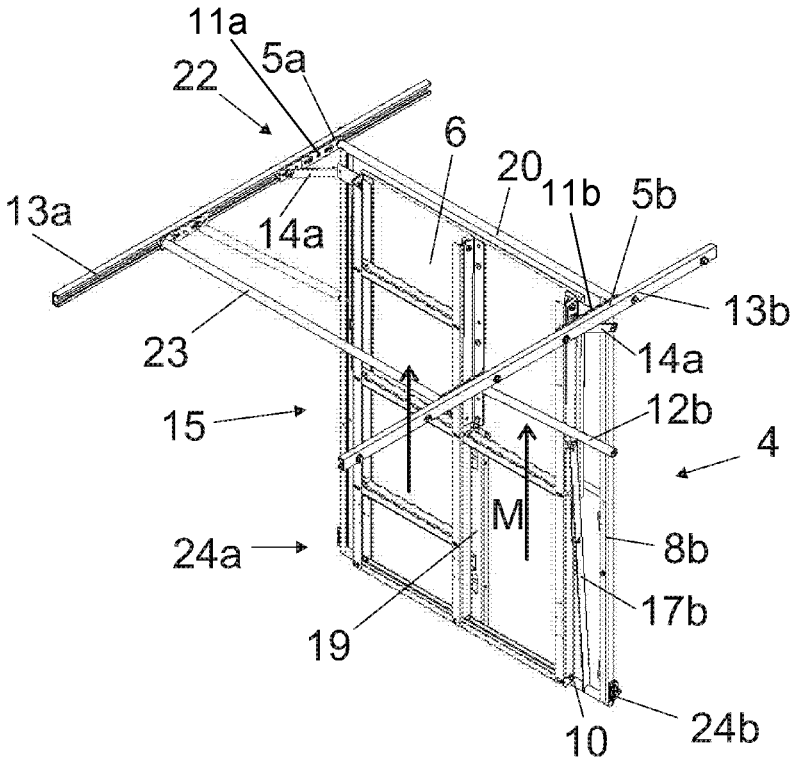
FIG. 4 is another schematic perspective top view of the arrangement shown in FIG. 1.
Figure 5:
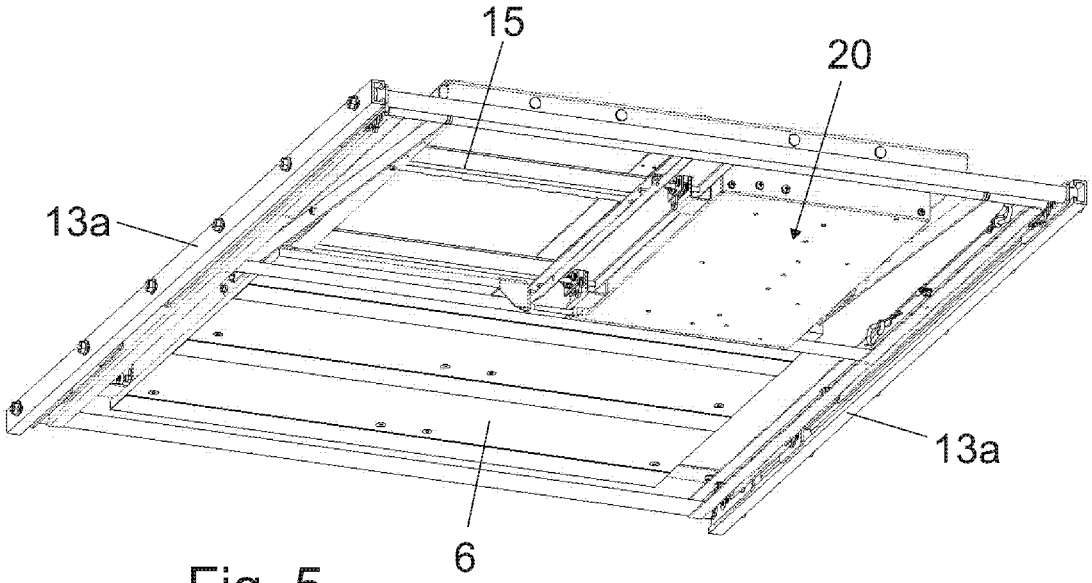
FIG. 5 is another schematic perspective view of the arrangement shown in FIG. 1 and seen below.
Figure 6:
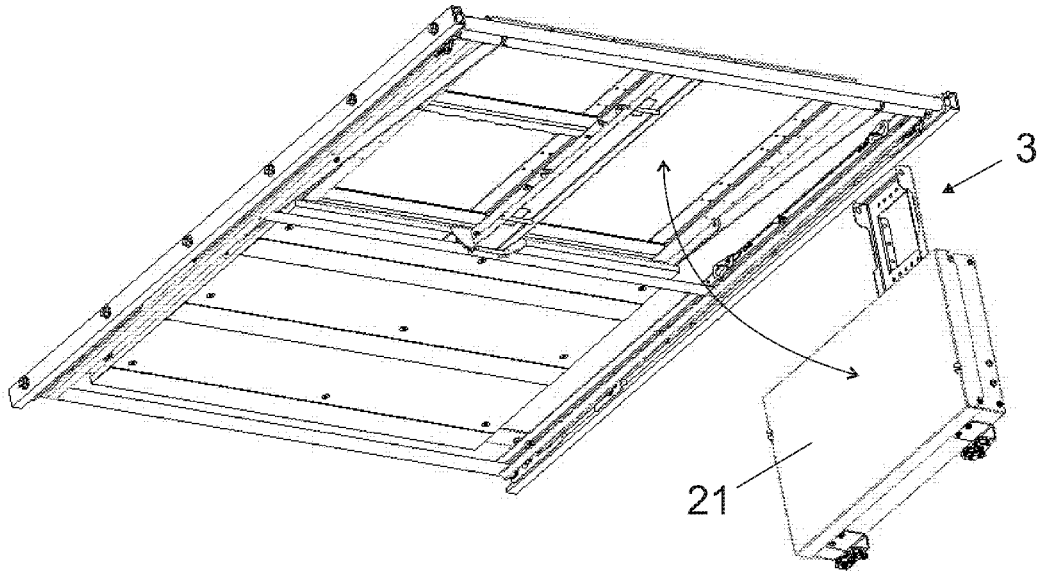
FIG. 6 is another schematic perspective view of the arrangement shown in FIG. 1 and seen below.

FIG. 1 is a schematic perspective top view of an arrangement, FIG. 2 is a schematic side view of an elevator car comprising the arrangement shown in FIG. 1 in partial cross-section, FIG. 3 is a schematic side view of the arrangement shown in FIG. 1, FIG. 4 is another schematic perspective top view of the arrangement shown in FIG. 1, FIG. 5 is another schematic perspective view of the arrangement shown in FIG. 1 and seen below, and FIG. 6 is still another schematic perspective view of the arrangement shown in FIG. 1 and seen below.

The elevator car 100 defines an interior space 1 for accommodating passengers. The elevator car 100 comprises an openable roof 2 as shown in FIG. 2. Furthermore, the elevator car 100 may comprise a ceiling 18.

The openable roof 2 may be realized in many ways; in an embodiment it comprises two or more movable roof elements and a locking adjustment to prevent at least one of the roof elements from moving.

Horizontal roof guide rails 13*a*, 13*b* are arranged on a top side of the elevator car 100, under the roof 2 but above the ceiling 18.

A support structure 4 is pivotably mounted to the guide rails 13*a*, 13*b* by a first joint 5*a*, 5*b*, and a working platform 6 is pivotably and movably mounted to the support structure 4 by a second joint 7*a*, 7*b* arranged at a distance from the first joint 5*a*, 5*b*.

In an embodiment, the support structure 4 comprises a framework that includes first suspension bars 8*a*, 8*b*. Each of the first suspension bars 8*a*, 8*b* is arranged between one first joint 5 and one third joint 24*a*, 24*b*. In an embodiment, such as shown in Figures, the first suspension bar 8*a*, 8*b* has an invariable length.

In an embodiment, the support structure 4 comprises at least one centre guide 19 that is arranged to extend from the lower connecting element 10 upwards. In the embodiment shown in Figures, the centre guide 19 extends to the transversally arranged element 9. In another embodiment, the centre guide 19 extends to a first upper connecting element 20 that is arranged between two first joints 5*a*, 5*b*.

In an embodiment, the second joint 7*a*, 7*b* connects the working platform 6 to the centre guide 19. The second joint 7*a*, 7*b* may comprise an axle that extends through the centre guide 19 and connects to the working platform 6 by its both ends. In another embodiment, there are two second joints 7*a*, 7*b* that are connected to the centre guide 19 on its opposite edges.

The working platform 6 is pivotable between a retracted position (shown in FIG. 5) in which said working platform is oriented close to the guide rails 13*a*, 13*b* in the top side of the elevator car, and a deployed position (shown in FIGS. 1 and 2), in which the working platform 6 is in the interior space 1, at a distance from the guide rails 13*a*, 13*b*.

The working platform 6 is in the retracted position during normal use of the elevator car 100. The working platform 6 is moved in the deployed position when needed, e.g. for a maintenance work. Then, the interior space 1 of the elevator car may create at least part, or even all, of a free safety space required for the maintenance work above the elevator car 100 when the elevator car is in its uppermost position. Thus, the elevator car 100 may be used e.g. in No-Head-Room (NHR) elevators.

The first joints 5*a*, 5*b* are arranged to move along the guide rails 13*a*, 13*b*. Thus, the support structure 4 and placement of the working platform in the deployed position may be changed (shown by arrow H in FIG. 3) once released by tilting the support structure 4.

In an embodiment, the guide rail 13*a*, 13*b* is selected from a C-profile, a L-profile, a T-profile and a U-profile.

In an embodiment, the guide rails 13*a*, 13*b* extend over the entire length of the openable roof 2.

In an embodiment, the first joint 5*a*, 5*b* is attached pivotably to a carriage 11*a*, 11*b* that is movable in/on the guide rail 13*a*, 13*b*. The carriage may comprise roller(s) for easing movement in/on the guide rail.

In an embodiment, the carriage 11*a*, 11*b* may comprise a locking mechanism 22 (shown in FIG. 4) arranged to prevent movement of the first joint 5*a*, 5*b* along the guide rail 13*a*, 13*b* when the suspension bars 8*a*, 8*b* are in their upright position. The second diagonal support element 14*a*, 14*b* is arranged movably and pivotally to the guide rail 13*a*, 13*b* and pivotally to the support structure 4. The second diagonal support element 14*a*, 14*b* actuates the locking mechanism 22 at the carriage 11*a*, 11*b* when the suspension bars 8*a*, 8*b* move in their upright position.

In an embodiment, the support structure 4 comprises at least one transversally arranged element 9 connected to the first suspension bars 8*a*, 8*b* around the middle part thereof. The transversally arranged element 9 creates a guard rail for the working platform 6 in its deployed position. The transversally arranged element 9 may comprise e.g. a bar, plurality of bars, etc.

In an embodiment, the framework comprises a lower connecting element 10 that is arranged between two third joints 24*a*, 24*b*. The lower connecting element 10 establishes a transversal support for the working platform 6 in its deployed position.

In an embodiment, the working platform 6 is attached to the support structure 4 not only pivotally but also movably in direction of the first suspension bars 8*a*, 8*b*. In this embodiment, the working platform 6 that is turned towards the first suspension bars 8*a*, 8*b* may be moved towards first joints 5*a*, 5*b*. In an embodiment, the centre guide 19 guides the trailing edge of the working platform (as shown by arrows M in FIG. 4) towards the first joints 5*a*, 5*b*, and vice versa. In another embodiment, the first suspension bars 8*a*, 8*b* comprises guides for said movement.

In an embodiment, a first diagonal support element 12*a*, 12*b* is arranged movably and pivotally to the guide rails 13*a*, 13*b*, and pivotally to the support structure 4. The first diagonal support element 12*a*, 12*b* connects diagonally the support structure 4 to the guide rail 13*a*, 13*b* when the working platform 6 is in the deployed position. The first diagonal support elements 12*a*, 12*b* also guide and steer the movement of the support structure 4 between the deployed position and the retracted position.

In an embodiment, the first diagonal support elements 12*a*, 12*b* are connected to each other by a second upper connecting element 23.

In an embodiment, the length of the working platform 6 is not more than 50% of the length of the support structure 4. However, in another embodiments, the length of the working platform 6 may be essentially more than 50% of said length, or essentially less than said 50%.

In an embodiment, the width of the working platform 6 corresponds at least substantially to the width of the openable roof 2.

In an embodiment, a ladder 15 is arranged pivotably to the working platform 6, on opposite side thereof in relation to the support structure 4. The ladder 15 extends from the working platform 6 towards a floor 16 of the elevator car when the working platform 6 is in the deployed position. In an embodiment, the ladder 15 is arranged to extend against said floor 16 and create a support for the working platform 6 in the deployed position.

In an embodiment, a ladder diagonal support 17*a*, 17*b* is arranged to control movement of the ladder 15 during movement of the working platform 6 between the retracted position and the deployed position. In an embodiment, such as shown in Figures, the ladder diagonal support 17*a*, 17*b* is attached movably to the ladder 17. In another embodiment, the ladder diagonal support 17*a*, 17*b* is attached movably to the support structure 4 or the working platform 6.

In an embodiment, such as shown in Figures, the width of the ladder 15 is essentially smaller than the width of the working platform 6, and the ladder 15 is arranged asymmetrically in relation to the working platform 6. In the embodiment shown in Figures, the ladder 15 is about half of the width of the working platform 6.

In the embodiment shown in Figures, the ladder 15 has a constant, invariable length. In another embodiment, the length of the ladder 15 is variable; it may have e.g. a telescopic structure.

In an embodiment, the support structure 4 and the working platform 6 lie in the retracted position between the openable roof 2 and a ceiling 18 of the elevator car.

In an embodiment, the elevator car comprises an equipment unit 21 that is arranged to lie next to the ladder 15 when the working platform 6 is in the retracted position. The equipment unit 21 may be e.g. a link box that may comprise electrical components of the elevator car, etc.

In an embodiment, the equipment unit 21 is attached to the elevator car 100 by a hinge system 3. The equipment unit 21 is pivotally movable from next to the ladder 15 to a lowered position inside the interior space 1 of the elevator car. The equipment unit 21 may e.g. hang on the hinge system 3 in the lowered position.

The invention is not limited solely to the embodiments described above, but instead many variations are possible within the scope of the inventive concept defined by the claims below. Within the scope of the inventive concept the attributes of different embodiments and applications can be used in conjunction with or replace the attributes of another embodiment or application.

The drawings and the related description are only intended to illustrate the idea of the invention. The invention may vary in detail within the scope of the inventive idea defined in the following claims.

REFERENCE SYMBOLS

1 interior space
2 openable roof
3 hinge system
4 support structure
5*a, b* first joint
6 working platform
7*a, b* second joint
8*a, b* first suspension bar
9 transversally arranged element
10 lower connecting element

11*a, b* carriage
12*a, b* first diagonal support element
13*a, b* guide
14*a, b* second diagonal support element
15 ladder
16 floor
17*a, b* ladder diagonal support
18 ceiling
19 centre guide
20 first upper connecting element
21 equipment unit
22 locking mechanism
23 second upper connecting element
24*a, b* third joint
100 elevator car
H horizontal movement
M movement

The invention claimed is:

1. An elevator car defining an interior space for accommodating passengers, the elevator car comprising:
- an openable roof;
- a ceiling;
- horizontal roof guide rails arranged on a top side of the elevator car below the openable roof;
- a support structure pivotably mounted to the guide rails by a first joint; and
- a working platform pivotably and movably mounted to the support structure by a second joint arranged at a distance from the first joint,
- wherein the working platform is pivotable between a fully retracted position, in which said working platform is oriented adjacent to and parallel to the guide rails on the top side of the elevator car, below the openable roof, and a deployed position, in which the working platform is in the interior space, at a distance from the guide rails,
- wherein the first joint is arranged to move along the guide rails, and
- wherein the support structure and the working platform, when in the retracted position, are arranged to lie between the openable roof and the ceiling of the elevator car.

2. The elevator car as claimed in claim 1, wherein the roof guide rails extend over an entire length of the openable roof.

3. The elevator car as claimed in claim 1, wherein the first joint is attached pivotably to a carriage-that is movable along the guide rails.

4. The elevator car as claimed in claim 3, wherein the support structure comprises a framework that includes suspension bars, each of the suspension bars being arranged between the first joint and a third joint, the elevator car further comprising a locking mechanism at the carriage to prevent movement of the first joints along the horizontal roof guide rails when the suspension bars are in an upright position.

5. The elevator car as claimed in claim 1, wherein the length of the working platform is not more than 50% of the length of the support structure.

6. The elevator car as claimed in claim 1, wherein a ladder is arranged pivotably to the working platform, on an opposite side thereof in relation to the support structure, the ladder extending from the working platform towards a floor of the elevator car when the working platform is in the deployed position.

7. The elevator car as claimed in claim 6, wherein the ladder is arranged to extend against the floor and create a support for the working platform in the deployed position.

8. The elevator car as claimed in claim 6, wherein a ladder diagonal support is arranged to control movement of the ladder during movement of the working platform between the retracted position and the deployed position.

9. The elevator car as claimed in claim 1, wherein the working platform is pivotable between the retracted position and the deployed position independent of opening the roof.

10. An elevator car defining an interior space for accommodating passengers, the elevator car comprising:
- an openable roof;
- horizontal roof guide rails arranged on a top side of the elevator car;
- a support structure pivotably mounted to the guide rails by a first joint; and
- a working platform pivotably and movably mounted to the support structure by a second joint arranged at a distance from the first joint,
- wherein the working platform is pivotable between a retracted position, in which said working platform is oriented adjacent to the guide rails on the top side of the elevator car, and a deployed position, in which the working platform is in the interior space, at a distance from the guide rails, and
- wherein the first joint is arranged to move along the guide rails,
- wherein the support structure comprises a framework that includes first suspension bars, each of the suspension bars being arranged between the first joint and a third joint.

11. The elevator car as claimed in claim 10, wherein the first suspension bar has an invariable length.

12. The elevator car as claimed in claim 10, wherein the support structure comprises at least one transversally arranged element connected to the first suspension bars between the first joint and the third joint, creating a guard rail for the working platform in the deployed position thereof.

13. The elevator car as claimed in claim 10, wherein the framework comprises a first upper connecting element arranged between two first joints.

14. The elevator car as claimed in claim 10, wherein the framework comprises a lower connecting element arranged between two third joints.

15. The elevator car as claimed in claim 14, wherein the support structure comprises a centre guide extending between the lower connecting element and the transversally arranged element.

16. The elevator car as claimed in claim 15, wherein the working platform is movably and pivotably connected to the centre guide by the second joint.

17. An elevator car defining an interior space for accommodating passengers, the elevator car comprising:
- an openable roof;
- horizontal roof guide rails arranged on a top side of the elevator car;
- a support structure pivotably mounted to the guide rails by a first joint; and
- a working platform pivotably and movably mounted to the support structure by a second joint arranged at a distance from the first joint,
- wherein the working platform is pivotable between a retracted position, in which said working platform is oriented adjacent to the guide rails on the top side of the elevator car, and a deployed position, in which the working platform is in the interior space, at a distance from the guide rails, and wherein the first joint is arranged to move along the guide rails, the elevator car further comprising a first diagonal support element arranged movably and pivotally to the guide rails, and pivotally to the support structure, the first diagonal support element-connecting diagonally the support structure to the guide rails when the working platform is in the deployed position.

18. The elevator car as claimed in claim 17, wherein a second upper connecting element is arranged to connect two first diagonal support elements at the guide rails.

19. The elevator car as claimed in claim 17, comprising a second diagonal support element arranged movably and pivotally to the guide rails and pivotally to the support structure, the second diagonal support element connecting diagonally the support structure to the guide rails when the working platform is in the deployed position, the second diagonal support element actuating the locking mechanism to prevent movement of the first joints along the horizontal roof guide rails when the suspension bars-are in an upright position.

20. An elevator car defining an interior space for accommodating passengers, the elevator car comprising:

an openable roof;

horizontal roof guide rails arranged on a top side of the elevator car;

a support structure pivotably mounted to the guide rails by a first joint; and a working platform pivotably and movably mounted to the support structure by a second joint arranged at a distance from the first joint, wherein the working platform is pivotable between a retracted position, in which said working platform is oriented adjacent to the guide rails on the top side of the elevator car, and a deployed position, in which the working platform is in the interior space, at a distance from the guide rails, wherein the first joint is arranged to move along the guide rails, wherein a ladder is arranged pivotably to the working platform, on an opposite side thereof in relation to the support structure, the ladder extending from the working platform towards a floor of the elevator car when the working platform is in the deployed position, and wherein the width of the ladder is smaller than the width of the working platform, and the ladder is arranged asymmetrically in relation to the working platform.

21. The elevator car as claimed in claim 20, comprising an equipment unit arranged to lie next to the ladder when the working platform is in the retracted position.

22. The elevator car as claimed in claim 21, wherein the equipment unit is attached to the elevator car by a hinge system, and wherein the equipment unit is pivotally movable from next to the ladder to a position inside the interior space of the elevator car.

* * * * *